US007238063B2

(12) United States Patent
Thompson

(10) Patent No.: US 7,238,063 B2
(45) Date of Patent: Jul. 3, 2007

(54) FIELD COMMUNICATION AND COMPUTER DATA DISTRIBUTION SYSTEM

(76) Inventor: Alvin Dean Thompson, 3745 SE. Hanway Rd., St. Joseph, MO (US) 64507

( * ) Notice: Subject to any disclaimer, the term of this patent is extended or adjusted under 35 U.S.C. 154(b) by 0 days.

(21) Appl. No.: 11/168,580

(22) Filed: Jun. 28, 2005

(65) Prior Publication Data

US 2006/0009066 A1 Jan. 12, 2006

Related U.S. Application Data

(60) Provisional application No. 60/583,505, filed on Jun. 28, 2004.

(51) Int. Cl.
*H01R 9/22* (2006.01)

(52) U.S. Cl. ..... 439/709; 439/535

(58) Field of Classification Search ..... 439/149, 439/404, 409, 535, 709; 174/59
See application file for complete search history.

(56) References Cited

U.S. PATENT DOCUMENTS 2,372,083 A * 3/1945 Johansson et al. ..... 174/57
5,611,710 A * 3/1997 Essrich ..... 439/513
5,641,312 A * 6/1997 Bippus et al. ..... 439/709
6,350,144 B1 * 2/2002 Afflerbaugh et al. ..... 439/412
6,764,356 B2 * 7/2004 Becher et al. ..... 439/835
6,780,044 B1 * 8/2004 Sawyer et al. ..... 439/417
7,097,516 B2 * 8/2006 Werner et al. ..... 439/709

* cited by examiner

*Primary Examiner*—Thanh-Tam Le
(74) *Attorney, Agent, or Firm*—Shughart Thomson & Kilroy PC

(57) ABSTRACT

A field communication and computer data distribution system includes a weatherproof housing with a hinged lid, a panel positioned in the housing and having a plurality of pairs of insulation displacement connector units mounted thereon, and a pair of multi-terminal box connectors on opposite sides thereof. A double pole, double throw switch interconnects each connector unit of a pair to perform testing functions. Auxiliary connectors are interconnected to selected pairs or groups of pairs of the connector units. The connector units and auxiliary connectors enable the connection of communication devices, such as telephone sets, to cables connected to the distribution box, as well as computer modems and network interface adapters.

16 Claims, 5 Drawing Sheets

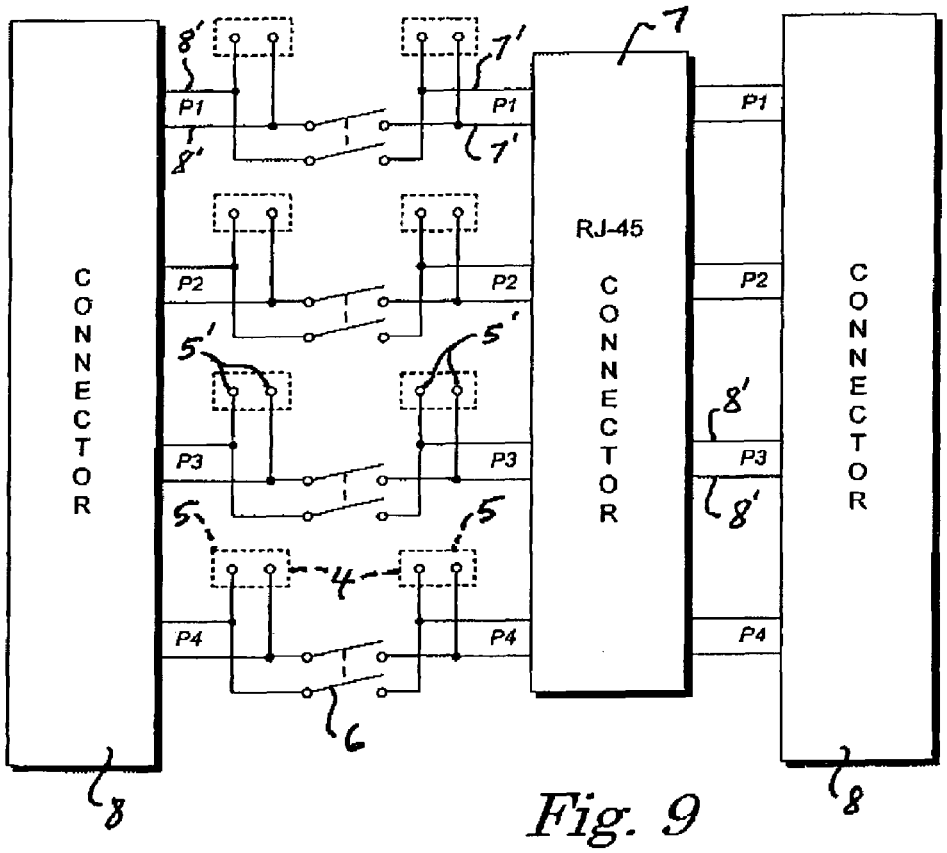
Fig. 9
Fig. 10
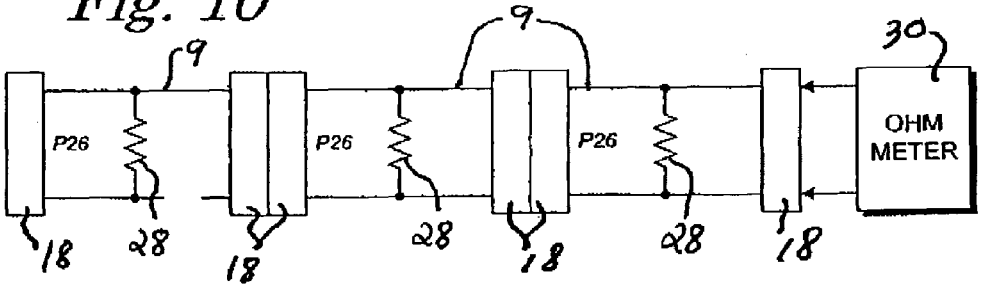

FIELD COMMUNICATION AND COMPUTER DATA DISTRIBUTION SYSTEM

CROSS-REFERENCE TO RELATED APPLICATION

This application claims priority under 35 U.S.C. 119(e) and 37 C.F.R. 1.78(a)(4) based upon copending U.S. Provisional Application Ser. No. 60/583,505 for FIELD COMMUNICATION AND COMPUTER DATA DISTRIBUTION SYSTEM, filed Jun. 28, 2004.

BACKGROUND OF THE INVENTION

The present invention relates to field communication distribution equipment and, more particularly, to improvements in individual and grouped connectors for such equipment and for testing the integrity of circuits employing such connectors.

The J-1077 A/U distribution box (hereinafter referred to simply as the "J-1077") is used to interconnect military field telephones and other communication devices in mobile, transportable, and semi-permanent installations. The J-1077 has provisions for connection of one or two 26 conductor-pair cables to a set of 26 pairs of spring post connectors mounted on a panel within the box. As such, the J-1077 can interconnect two 26-pair cables or can terminate a single 26-pair cable and provide connections to the conductors within the cable, such as for telephone sets or test equipment. The J-1077 has been in use for several decades and has proved to be generally rugged and reliable in varied field conditions. Additional information about the J-1077 distribution box can be obtained from Associated Industries of North Hollywood, Calif. (www.associated-ind.com) and from other sources.

Although generally successful, the J-1077 has some shortcomings. The configuration of the spring post connectors requires that wires be stripped before insertion into the posts. Stripping sometimes damages some of the strands of a conductor, causing them to break off, thereby reducing the signal carrying capability of the conductor. Stripping is also time-consuming if a large number of connections need to be made at one time.

Another problem with the J-1077 is that if a communication malfunction occurs in a system using J-1077 distribution boxes and cables, it is often difficult and time-consuming to isolate the problem among the possible 26 circuits which may be in use. At present, the usual procedure is to disconnect and reconnect each wire until the problem is isolated. A related problem is detecting the location of a break or cut in the cable or unauthorized connections to the network, such as by an enemy. Finally, there are no provisions on a standard J-1077 box for connection of computers thereto to enable field networking of computers or data communication between computerized devices using the J-1077 system.

SUMMARY OF THE INVENTION

The present invention provides a number of improvements in the J-1077 distribution box. In the present invention, the spring post connectors are replaced by sets of insulation displacement connectors (IDC). Each insulation displacement connector generally has a movable top section which comprises two wire insertion holes and a lower fixed section which houses a pair of terminal strips. The terminal strips have a wire engaging portion at one end for engaging and making electrical contact with a wire. The terminal strips are generally parallel to one another but offset to provide a sufficient dielectric strength between them. In order to establish an electrical connection between the wires and the terminal strips a user first opens the top section, i.e., pivots the top section to its open position, inserts the pair of wires, and then closes the top section. Upon closing the top section of the connector, the wires are forced through the terminal strip engaging portion to make electrical and mechanical contact with the terminal strips. To remove the wires and/or break the electrical connection, the process is reversed. Each spring binding post on the connector panel of the J-1077 distribution box is replaced by an insulation displacement connector unit. The connectors of the present invention are mounted on the J-1077 panel in pairs in the same manner as the spring binding posts they replace.

The connectors typically carry audio frequency communication signals. In order to facilitate troubleshooting to find which circuit may have a problem, it is a common practice to remove a conductor from a binding post, one at a time, until the problem circuit is identified. Such disconnecting and reconnecting is laborious and can damage the stripped wire ends, requiring that the wire end be stripped before reconnecting. The present invention overcomes this problem by providing a tea switch in at least one conductor of each pair. By this means, the test switch can be opened to disconnect the circuit instead of physically removing the conductor from the connector. Preferably, a double pole, single throw switch is connected between the pairs of terminals of the pair of connector devices.

The present invention provides a means of detecting the approximate location of a cut or break in one of a series of interconnected cables of the type that are used with the J-1077 distribution box. Typically, the cables are formed by 26 numbered pairs of conductors. Normally, only 25 pairs carry communication signals, while the No. 26 pair is used for testing and troubleshooting purposes. The present invention provides at least one resistor per cable, connected across the No. 26 conductor pair. When a plurality of cables are interconnected end to end by J-1077 boxes, the resistors of the cables are connected in parallel. If the resistance of the parallel combination is measured, the number of unbroken cable sections can be determined from the composite resistance and compared with the composite resistance expected from the number of cables present.

A standard resistor may also be connected across each end of the No. 26 pair of each cable section. By this means, the integrity of a single cable section can be determined by measuring the resistance across the No. 26 conductor pair.

In order to provide for digital communications between computers and computerized equipment, the improved J-1077 type distribution box of the present invention may have some of the insulation displacement connectors interconnected to connectors more appropriate for computer networks or for interconnections between modems. Such connectors can include, but are not limited to, RJ-45, RJ-11, and RJ-12 modular type connectors; BNC type connectors; and other connectors commonly employed for interconnections between computers. Conductors of the cables interconnecting the improved J-1077 boxes and carrying data between computers may be shielded separately from the other conductor pairs to minimize possible interference to and from other signals on other conductor pairs. Data connectors and associated cable conductors would provide some limited computer networking capabilities in addition to more conventional analog voice communications in systems employing J-1077 type distribution boxes. Alternatively, other types of connectors can be connected to selected insulation displacement connectors, such as standard phone connectors, F-type connectors, fiber optic adapters, and other standard types of network, telephone, audio, video, and signal connectors.

Various objects and advantages of this invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

BRIEF DESCRIPTION OF THE DRAWINGS

FIG. 9 is a schematic diagram illustrating test switches interconnecting terminals of pairs of insulation displacement connectors of the modified J-1077 distribution box of the present invention and further illustrates the connection of a multiconductor connector to a plurality of pairs of the insulation displacement connectors.

FIG. 10 is a schematic diagram illustrating a plurality of interconnected cables of the present invention with resistors to enable the location of a break in a cable.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
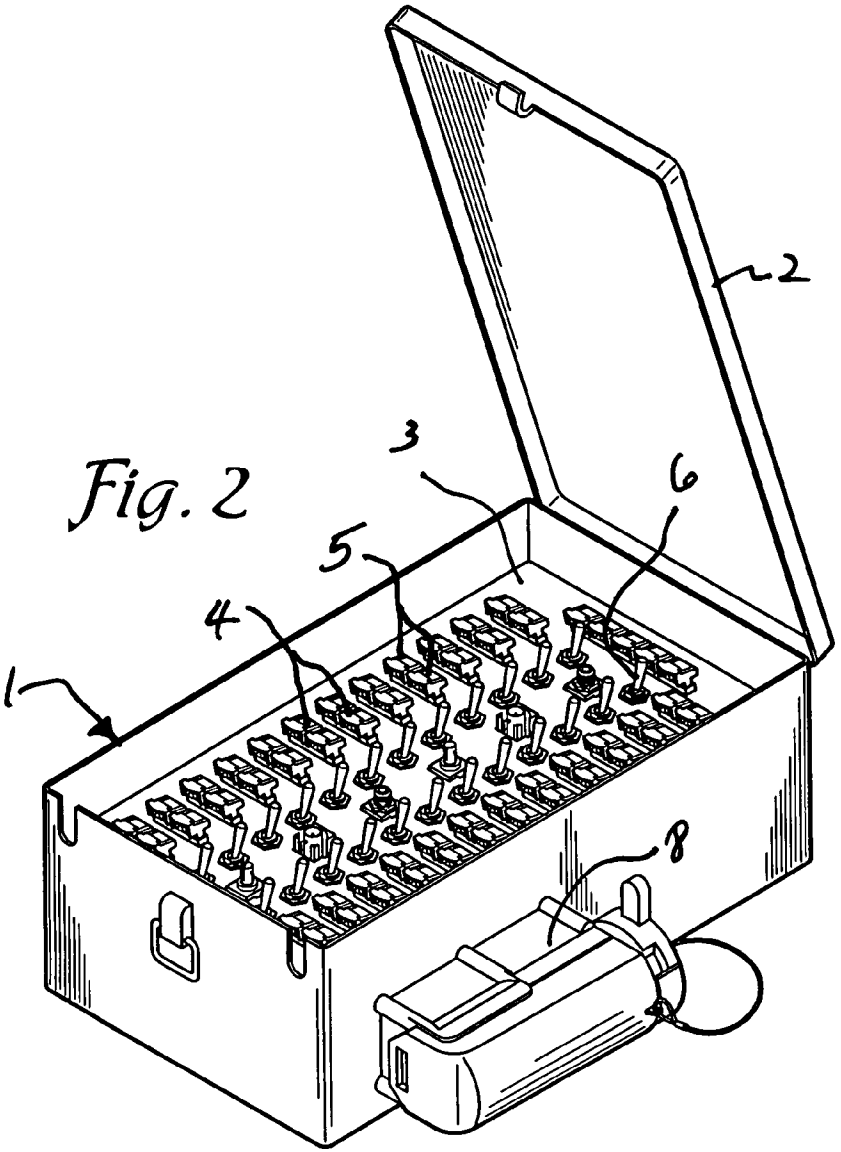
FIG. 2 is a perspective view of a J-1077 box with insulation displacement connector sets and test switches which embodies the present invention.
Figure 3:
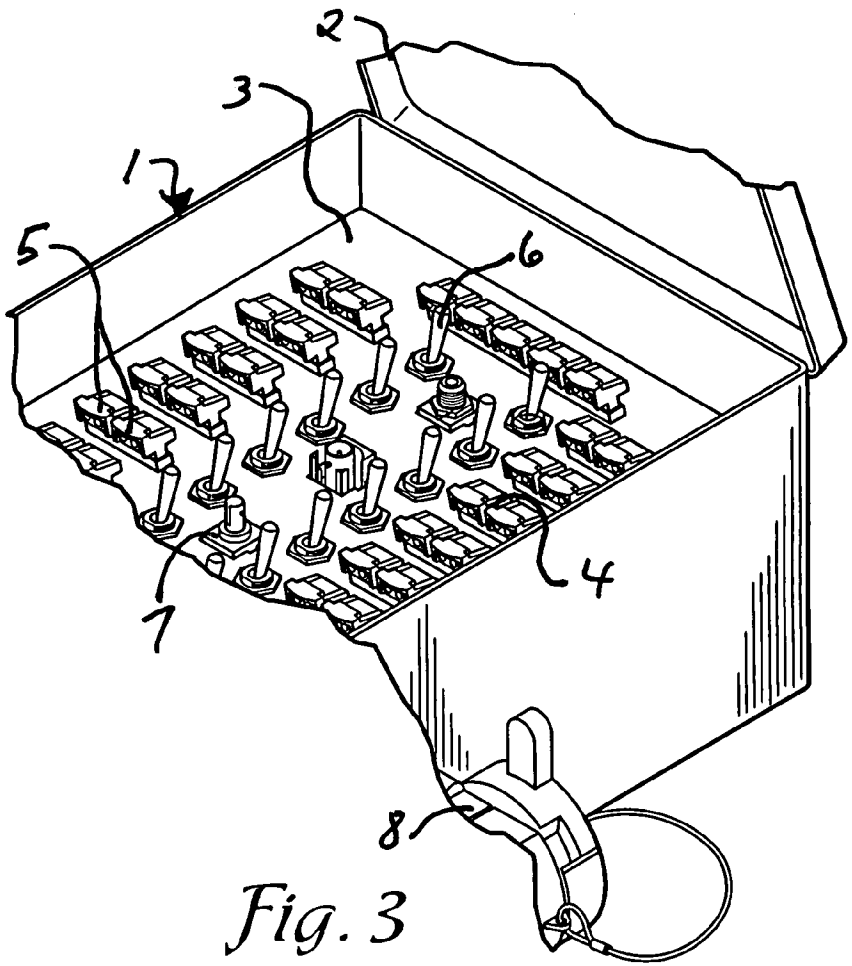
FIG. 3 is an enlarged fragmentary perspective view similar to FIG. 2 and illustrates elements the modified J-1077 box in more detail.

Referring to the drawing in more detail, the reference numeral 1 (FIGS. 2 and 3) generally designates an improved field communication distribution box which embodies the present invention. The box 1 generally includes an access door or lid 2 hingedly connected thereto and a connector panel 3 positioned in the box 1 and having pairs 4 of insulation displacement connectors 5, test switches 6, and auxiliary connectors 7 mounted thereon. The box 1 has box connectors 8 mounted on sides thereof to enable connection of cables 9 to the connectors 5 and 7 thereof. Conversely, the connectors 5 and 7 enable connection of communication devices 10 to the cables 9 (FIG. 1) for communication with other devices 10 (FIG. 1) connected to the cables 9.

Figure 1:
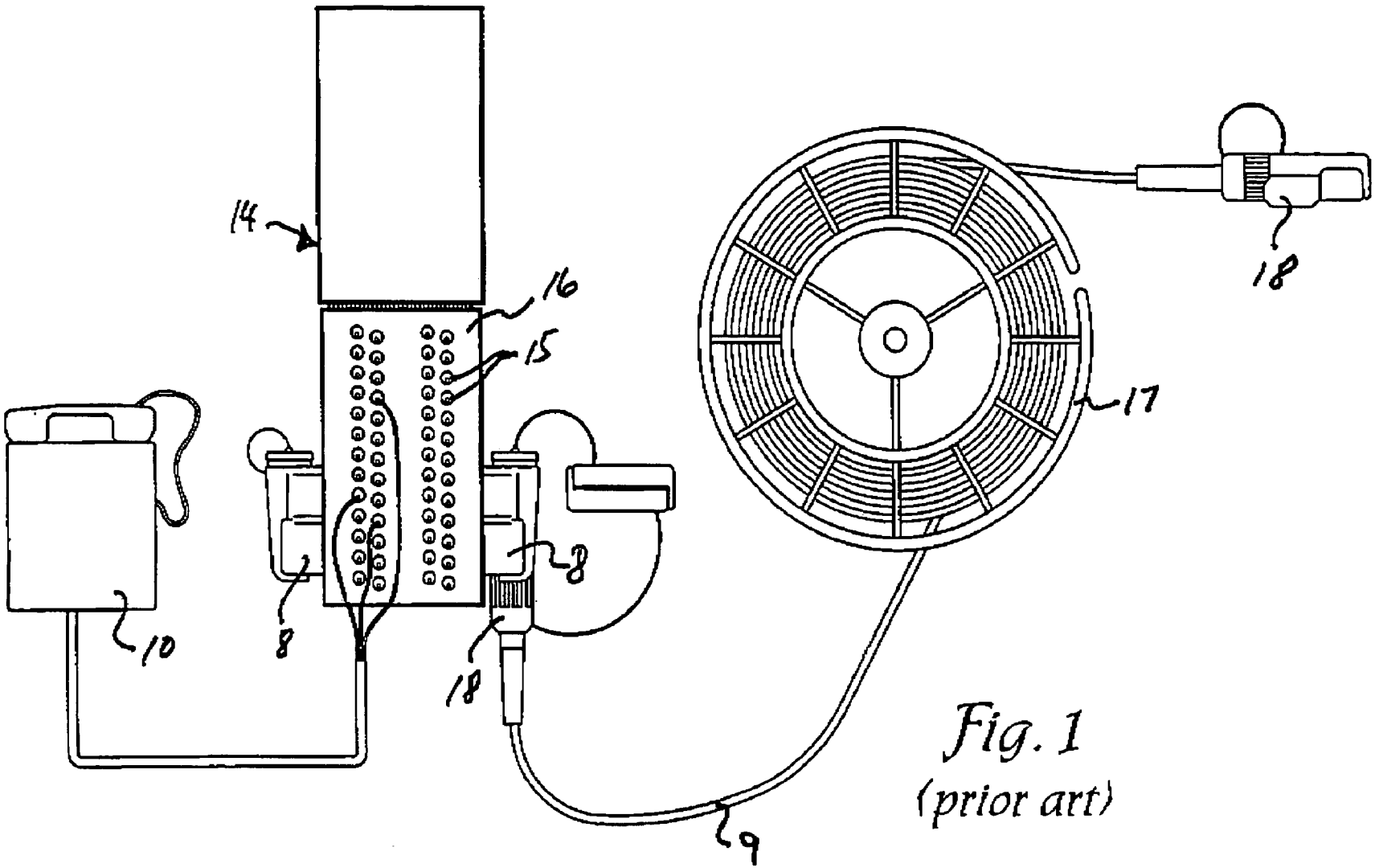
Fig. 1 (prior art)
FIG. 1 is a view of a J-1077 field communication distribution box along with a cable reel and cable and a telephone set.

Referring to FIG. 1, the conventional field communication distribution box 14, with the military designation J-1077 A/U or simply J-1077, has a plurality of spring post connectors 15 mounted on a panel 16. The box 14 has the capability of interconnecting a pair of the cables 9 and provides for the connection of communication devices 10, such as telephone sets, to conductor pairs in the cables 9. FIG. 1 shows a cable reel 17 on which a cable 9 is stored and from which it is paid out from one box 14 to the next. The illustrated cable 9 (designated as CX-4566 A/G) has 26 numbered pairs of conductors and terminates at each end in a multi-terminal cable connector 18 (designated as a U-185 B/G connector). The cable connectors 18 mate with one of the box connectors 8 (designated U-187 A/G connectors) to interconnect two cables 9 and to enable connections of the devices 10 to the conductors of the cables 9.

Figure 7:
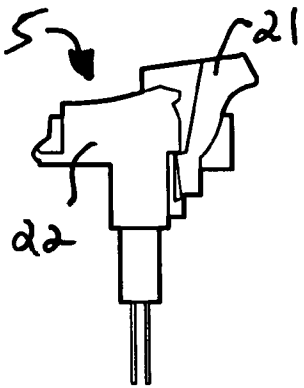
FIG. 7 is a greatly enlarged side elevational view of an insulation displacement connector used in the modified J-1077 distribution box of the present invention, with a top section shown in a closed position.
Figure 8:
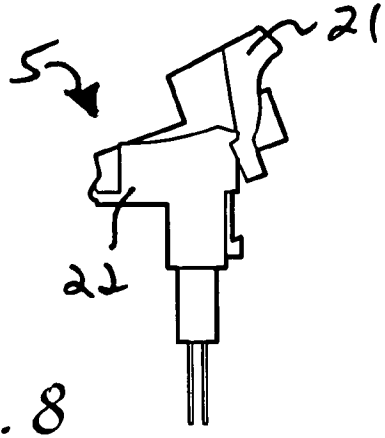
FIG. 8 is a view similar to FIG. 7 and illustrates the insulation displacement connector with the top section shown in an opened position.

The insulation displacement connector 5 generally has a movable top section 21 which comprises two wire insertion holes and pivotally connected to a lower fixed section 22 which houses a pair of terminal strips. The terminal strips (not shown) have a wire engaging portion at one end for engaging and making electrical contact with a wire. The terminal strips are generally parallel to one another but offset to provide a sufficient dielectric strength between them. The top movable section 21 of the connector 5 pivots about a fixed axis located toward the back side of the connector. The top section 21 has a movable latch member to maintain the top section in its closed position. To open the top section, a user the top section to its raised or open position (FIG. 8). When the top section is open, the terminal strips do not intersect the wire insertion holes, and when the top section is closed (FIG. 7), the terminal strips intersect the wire insertion holes. In order to establish an electrical connection between the wires and the terminal strips a user first opens the top section, i.e., pivots the top section to its open position, inserts the pair of wires, and then closes the top section. Upon closing the top section of the connector, the wires are forced through the terminal strip engaging portion to make electrical and mechanical contact with the terminal strips. To remove the wires and/or break the electrical connection, the process is reversed. A preferred type of insulation displacement connector 5 is manufactured by Channell Commercial Corporation of Temecula, Calif. (www.channellcomm.com) and sold under the trademark Mini-Rocker.

Each set of spring binding posts 15 on the connector panel of the conventional J-1077 distribution box 14 is replaced by a set 4 of insulation displacement connector units or connector devices 5. The pair of connector units 5 provides for redundancy should one of the receptacles malfunction or be damaged. The insulation displacement connectors 5 enable faster and more reliable connections since the wires to be inserted do not require stripping. The terminals 5' (FIG. 9) of each connector unit 5 are connected to associated pairs of conductors 8' in the box conectors 8. Referring to FIG. 9, the terminals of a first one of the pair 4 of connector units 5 are connected to the box connector 8 on one side of the box 1 while the terminals of the second of the pair 4 are connected to the box connector 8 on the apposite side of the box 1.

In order to facilitate troubleshooting to find which circuit may have a problem, it is a common practice with the older box 14 to remove a conductor from a binding post 15, one at a time, until the problem circuit is identified. Such disconnecting and reconnecting is laborious and can damage the stripped wire ends, requiring that the wire end be stripped before reconnecting. The present invention overcomes this problem by providing a test switch 6 to interconnect the sets of terminals of each pair 4 of connector units 5. A double pole, single throw switch configuration is preferred. When the switch contacts are closed, the terminals of each pair 4 are interconnected. However, when the switch contacts are opened, the conductors of cables 9 on both sides of the box 1 can be individually tested, without removing wires from the connector units 5.

The present invention provides a means of detecting the approximate location of a cut or break in one of a series of interconnected cables 9. Typically, the cables 9 are formed by 26 numbered pairs of conductors. Normally, only 25 pairs carry communication signals, while the No. 26 pair is used for testing and troubleshooting purposes.

Referring to FIG. 10, the present invention provides at least one resistor 28 per cable, connected across the No. 26 conductor pair. The value of the resistor is standardized and may range from about 1000 ohms (1 kilohm) to several hundred kilohms. A number of cables 9 are normally strung together end-to-end using boxes 10 or other kinds of appropriate connectors. Normally, a technician will be aware of the exact number of cables 9 present in a given communication network. Each cable 9 added, in the present invention, connects an additional resistor 28 in parallel, thereby further dividing the equivalent resistance of all the interconnected resistors 28. Additionally, the resistance of a given length of the conductor pair is known. The unbroken length of the composite cable is related to the equivalent resistance measured across the No. 26 conductor pair. If the value of the standard resistor is relatively high, the in-line resistance of the conductor pair is less significant in proportion to the standard resistors, such that the equivalent resistance of the cable is effectively the parallel combination of the standard resistors. Thus, the equivalent resistance of the cable is inversely proportional to the length of the composite cable.

For example, if the composite cable is formed by ten cable sections, each with a standard resistor connected across the No. 26 pair, then the equivalent resistance measured is one tenth of the value of the standard resistor. However, if ten cable sections should be present and the resistance measured by an ohm meter 30 from one end is, for example, one seventh the value of the standard resistor, then the technician knows that there is a break in the eighth section. By this means, the broken cable section can be replaced or repaired quickly and directly without the need to inspect each section. Alternatively, resistor 28 may be connected across each end of the No. 26 pair of each cable section 9. By this means, the integrity of a single cable section 9 can be determined by measuring the resistance across the No. 26 conductor pair.

The present invention also contemplates connecting a cable monitor circuit to the No. 26 cable pair which monitors the equivalent resistance of the composite cable. Such a cable monitor would preferably be based on a programmable digital computer or at least a programmable microprocessor to provide for a variety of desirable features. The number of sections and the value of the standard resistor are entered into the monitor circuit. If the monitored resistance varies by greater than a selected tolerance, an alarm is activated. The change in resistance could be a consequence of the cable being damaged or being disconnected by an enemy to insert listening equipment into the line. In either case, once the occurrence to line interruption has been alerted, the approximate location of the break can be located by the procedures described previously.

In some applications, it may be desirable to provide in-line electrical fuses (not shown) to the conductors of the cable to protect circuits and equipment connected thereto. Such fuses may be rated at relatively low levels of current, such as 375 milliampers, because of the relatively low power levels of signals intended to be carried by the conductors of the system. The fuses protect the circuits connected thereto from damage due to short circuits, current surges, and the like. The fuses are preferably provided in such a manner that they can be easily replaced if blown.

In order to provide for digital communications between computers and computerized equipment, the improved type box of the present invention may have various types of auxiliary connectors 7 having auxiliary connector terminals 7' interconnected to the terminals 5' of the insulation displacement connector units 5. Such connectors can include, but are not limited to, RJ-45, RJ-11, and RJ-12 modular type connectors; BNC type connectors; F-type connectors, fiber optic adapters, and other connectors commonly employed for interconnections between computers, computer networks, modems, and the like. Conductors of the cables 9 interconnecting the boxes 1 and carrying data between computers may be shielded separately from the other conductor pairs to minimize possible interference to and from other signals on other conductor pairs. Data connectors and associated cable conductors would provide some limited computer networking capabilities in addition to more conventional analog voice communications in systems employing conventional J-11077 type distribution boxes.

Figure 4:
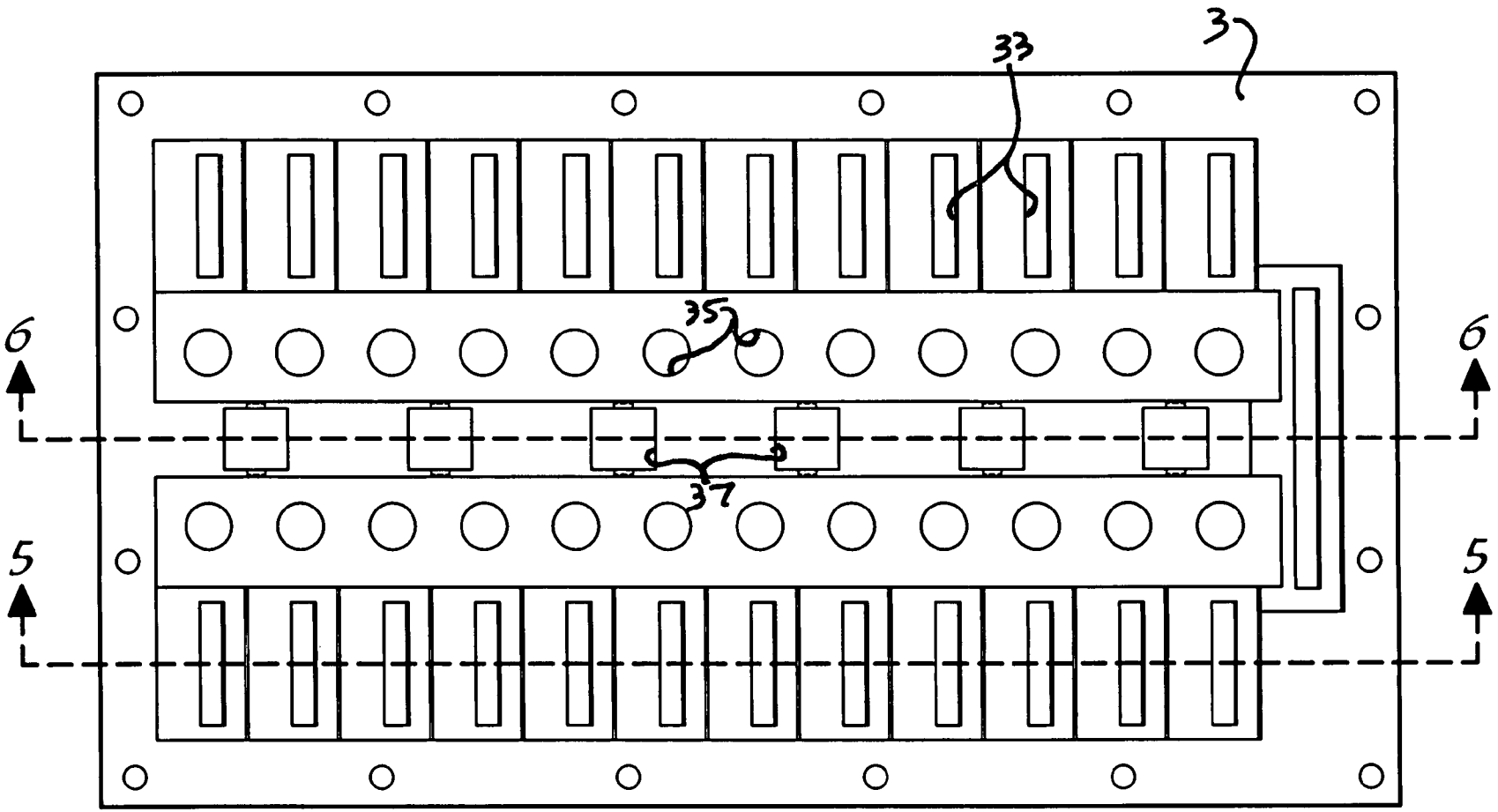
FIG. 4 is an enlarged plan view of a connector panel of the modified J-1077 box with connectors and switches removed.
Figure 5:
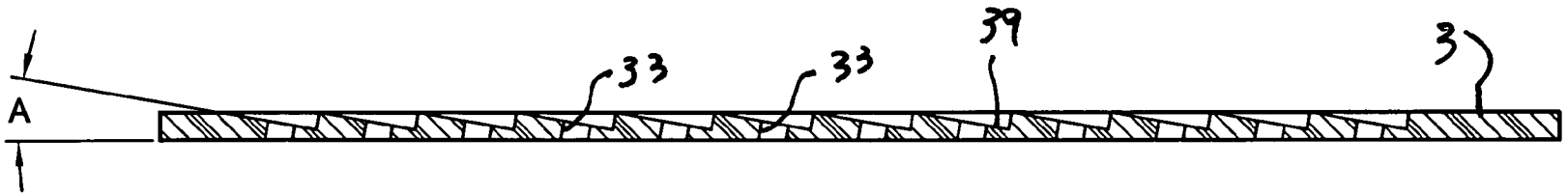
FIG. 5 is a longitudinal sectional view of the modified connector panel taken on line 5-5 of FIG. 4.
Figure 6:
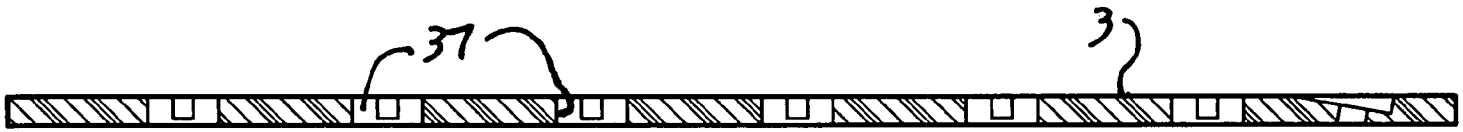
FIG. 6 is a longitudinal sectional view of the modified connector panel taken on line 6-6 of FIG. 4.

FIGS. 4-6 illustrate an improved panel 3 suitable for use with the modified distribution box 1. The panel 3 includes slots 33 to receive pairs 4 of the connector units 5, circular apertures 35 to receive the test switches 6, and square openings 37 to receive the auxiliary connectors 7. As shown in FIG. 5, the panel 3 may have its surface relieved in an angular configuration around the slots 33 at 39 to position the connector units 5 at a more convenient attitude for access by a technician.

It is to be understood that while certain forms of the present invention have been illustrated and described herein, it is not to be limited to the specific forms or arrangement of parts described and shown.

What is claimed and desired to secure by Letters Patent is:

1. A field communication distribution apparatus for use with a cable formed by a plurality of cable conductor pairs to enable temporary connection communication devices to said conductor pairs, said cable terminating in a cable connector including pairs of terminals for each of said conductor pairs, said apparatus comprising:

(a) a weatherproof housing;

(b) a panel positioned in said housing and having a plurality of connector devices mounted thereon;

(c) each of said connector devices including a pair of insulation displacement connectors therein which enable connection thereto of unstripped insulated conductors of a communication device;

(d) a box connector having a plurality of box conductor pairs, each box conductor pair being connected to a respective pair of insulation displacement connectors of one of said connector devices, said box connector being compatible with said cable connector to enable removable connection of said cable to said box connector; and (e) an auxiliary connector on said panel and having auxiliary connector terminals connected to the insulation displacement connectors of a selected connector device, said auxiliary connector being of a standard configuration to enable connection of a communication device having a connector compatible with said auxiliary connector to a conductor pair of said cable.

2. An apparatus as set forth in claim 1 wherein each of said connector devices is a first connector divide and including:

(a) a second connector device paired with each of said first connector devices, each of said second connector devices being mounted in spaced relation to an associated first connector device and having a pair of insulation displacement connectors therein which are connected in parallel with the insulation displacement connectors of the associated first connector device.

3. An apparatus as set forth in claim 2 wherein each pair of the first connector device and the second connector device includes:

(a) a double pole, single throw switch interconnecting the insulation displacement connectors of said first connector device with the insulation displacement connectors of said second connector device.

4. An apparatus as set forth in claim 2 wherein said box connector is a first box connector with first box conductor pairs connected respectively to insulation displacement connectors of the associated first connector devices and wherein:

(a) said apparatus includes a second box connector substantially similar to said first box connector and having second box conductor pairs connected respectively to the insulation displacement connectors of associated second connector devices.

5. An apparatus as set forth in claim 4 and including:

(a) a double pole, single throw switch interconnecting the insulation displacement connectors of said first connector device with the insulation displacement connectors of said second connector device, said switch enabling identification of a relative location of a communication fault in cables connected respectively to said first box connector and said second box connector.

6. An apparatus as set forth in claim 1 and including:

(a) a plurality of connection jacks the auxiliary connectors mounted on said panel, each of said auxiliary connectors having respective auxiliary connector terminals connected to the insulation displacement connectors of a selected connector device, said auxiliary connectors being of standard configurations to enable connection of communication devices having connectors compatible respectively with said auxiliary connectors to selected conductor pairs of said cable.

7. An apparatus as set forth in claim 1 and including:

(a) a selected one of said auxiliary connectors mounted on said panel having a plurality of auxiliary connector terminals connected to pairs of the insulation displacement connectors of a selected plurality of said connector devices, the selected auxiliary connector being of a standard configuration to enable connection of a communication device having a connector compatible with said selected auxiliary connector to the selected conductor pairs of said cable.

8. An apparatus as set forth in claim 1 wherein said box connector is a first box connector with first box conductor pairs connected respectively to insulation displacement connectors of associated connector devices and wherein:

(a) said apparatus includes a second box connector substantially similar to said first box connector and having second box conductor pairs connected respectively to said insulation displacement connectors of said associated connector devices thereby enabling said apparatus to interconnect two of said cables; and (b) each cable includes a resistor connected across a selected conductor pair to enable determination of a relative location of a cut in one of a plurality of said cables interconnected by a plurality of said apparatus.

9. A field communication distribution apparatus for use with a cable formed by a plurality of cable conductor pairs to enable temporary connection communication devices to said conductor pairs, said cable terminating in a cable connector including pairs of terminals for each of said conductor pairs, said apparatus comprising:

(a) a weatherproof housing;

(b) a panel positioned in said housing and having a plurality of pairs of first and second connector devices mounted thereon, each connector device including a pair of insulation displacement connectors therein which enable connection thereto of unstripped insulated conductors of a communication device;

(c) each pair of the first and the second connector device being mounted in spaced relation and having the pairs of insulation displacement connectors thereof connected in parallel with the insulation displacement connectors of the associated connector device in the pair;

(d) a double pole, single throw switch interconnecting the insulation displacement connectors of said first connector device of a pair of connector devices with the insulation displacement connectors of said second connector device of the pair;

(e) a first box connector and a second box connector mounted on said housing, each box connector having a plurality of box conductor pairs, each first box conductor pair being connected to a respective pair of insulation displacement connectors of one of said first connector devices of one of the pairs of connector devices and an associated second box conductor pair being connected to the pair of insulation displacement connectors of the second connector device associated with said one first connector device, each of said box connectors being compatible with said cable connector to enable removable connection of a pair cables to said first and second box connectors;

(f) each switch enabling identification of a relative location of a communication fault in the cables connected respectively to said first box connector and said second box connector; and (g) an auxiliary connector mounted on said panel and having auxiliary connector terminals connected to the insulation displacement connectors of a selected connector device, said auxiliary connector being of a standard configuration to enable connection of a communication device having a connector compatible with said auxiliary connector to a conductor pair of said cable.

10. An apparatus as set forth in claim 9 and including:

(a) a plurality of the auxiliary connectors mounted on said panel, each of said auxiliary connectors having respective auxiliary connector terminals connected to the insulation displacement connectors of a selected connector device, said auxiliary connectors being of standard configurations to enable connection of communication devices having a connectors compatible respectively with said auxiliary connectors to selected conductor pairs of said cable.

11. An apparatus as set forth in claim 10 and including:

(a) selected one of said auxiliary connectors mounted on said panel having a plurality of auxiliary connector terminals connected to pairs of the insulation displacement connectors of a selected plurality of said connector devices, the selected auxiliary connector being of a standard configuration to enable connection of a communication device having a connector compatible with said selected auxiliary connector to the selected conductor pairs of said cable.

12. An apparatus as set forth in claim 11 wherein:

(a) said selected auxiliary connector enables connection of a standard telephone device to said cable.

13. An apparatus as set forth in claim 11 wherein:

(a) said selected auxiliary connector enables connection of a standard computer network interface adapter to said cable.

14. An apparatus as set forth in claim 9 wherein:

(a) each cable connected to said apparatus include a resistor connected across a selected conductor pair to enable determination of a relative location of a cut in one of a plurality of said cables interconnected by a plurality of said apparatus.

15. A field communication distribution apparatus for use with a cable formed by a plurality of cable conductor pairs to enable temporary connection of communication devices to said conductor pairs, said cable terminating in a cable connector including pairs of terminals for each of said conductor pairs, said apparatus comprising:

(a) a weatherproof housing;

(b) a panel positioned in said housing and having a plurality of pairs of first and second connector devices mounted thereon, each of said connector devices including a pair of insulation displacement connectors therein which enable connection thereto of unstripped insulated conductors of a communication device;

(c) each pair of the first and the second device being mounted in spaced relation and having the pairs of insulation displacement connectors thereof connected in parallel with the insulation displacement connectors of the associated connector device in the pair;

(d) a double pole, single throw switch interconnecting the insulation displacement connectors of said first connector device of a pair of connector devices with the insulation displacement connectors of said second connector device of the pair;

(e) a first box connector and a second box connector mounted on said housing, each of said box connectors having a plurality of box conductor pairs, each of said first box conductor pairs being connected to a respective pair of the insulation displacement connectors of one of said first connector device of one of the pairs of connector devices and an associated second box conductor pair being connected to the pair of insulation displacement connectors of the second connector device associated with said one first connector device, each of said box connectors being compatible with said cable connector to enable removable connection of a pair cables to said first and second box connectors;

(f) each switch enabling identification of a relative location of a communication fault in the cables connected respectively to said first box connector and said second box connector;

(g) a plurality of auxiliary connectors mounted on said panel, each of said auxiliary connectors having auxiliary connector terminals connected to the insulation displacement connectors of selected connector device, said auxiliary connectors being of standard configurations to enable connection of communication devices having a connectors compatible with said auxiliary connectors to selected conductor pairs of said cable; and (h) a selected one of said auxiliary connectors mounted on said panel having a plurality of auxiliary connector terminals connected to pairs of the insulation displacement connectors of a selected plurality of said connector devices, the selected auxiliary connector being of a standard configuration to enable connection of a communication device having a plug connector compatible with said selected auxiliary connector to the selected conductor pairs of said cable.

16. An apparatus as set forth in claim 15 wherein:

(a) each cable connected to said apparatus includes a resistor connected across a selected conductor pair to enable determination of a relative location of a cut in one of a plurality of said cables interconnected by a plurality of said apparatus.

* * * * *

UNITED STATES PATENT AND TRADEMARK OFFICE

CERTIFICATE OF CORRECTION

PATENT NO. : 7,238,063 B2
APPLICATION NO. : 11/168580
DATED : July 3, 2007
INVENTOR(S) : Alvin Dean Thompson It is certified that error appears in the above-identified patent and that said Letters Patent is hereby corrected as shown below:

In the Claims:

Column 6, line 50 insert --of-- after the word “connection”;

Column 7, line 44 delete “connection jacks”;

Column 9, line 39 insert --connector-- after the word “second”;

Column 10, line 27 delete “a” after the word “having”;

Column 10, line 36 delete “plug”.

Signed and Sealed this

Twenty-fifth Day of December, 2007

JON W. DUDAS
*Director of the United States Patent and Trademark Office*